United States Patent [19]

Clarke et al.

[11] Patent Number: 4,790,360

[45] Date of Patent: Dec. 13, 1988

[54] WOOD TENDERIZING APPARATUS AND METHOD

[75] Inventors: Michael R. Clarke, West Vancouver; Donald C. Walser, Surrey, both of Canada

[73] Assignee: Forintek Canada Corp., Vancouver, Canada

[21] Appl. No.: 112,297

[22] Filed: Oct. 26, 1987

[51] Int. Cl.[4] ..... B27L 5/00; B27M 1/02

[52] U.S. Cl. ..... 144/213; 29/121.6; 100/121; 144/2 R; 144/2 J; 144/362

[58] Field of Search ..... 144/2 R, 2 J, 209 R, 144/213, 361, 362; 29/121.6; 100/121

[56] References Cited

U.S. PATENT DOCUMENTS

| | | | |
|---|---|---|---|
| 3,125,141 | 3/1964 | Best et al. | 144/2 J |
| 4,137,956 | 2/1979 | Toberg | 144/2 J |
| 4,385,650 | 5/1983 | Schmidt | 144/246 C |
| 4,655,869 | 4/1987 | Tellman et al. | 144/2 R |
| 4,691,629 | 9/1987 | Koba | 29/121.6 |

*Primary Examiner*—W. Donald Bray
*Attorney, Agent, or Firm*—William H. James

[57] ABSTRACT

A wood incising roller where the teeth are formed by grooves in the roller surface and where some of such grooves cross others. Each cutting tooth has a knife-like cutting edge of finite length that is in one instance perpendicular to the axis of rotation of the roller and in another instance parallel to such axis. The grooves can be formed by machine cutting, either turning or grinding or by being molded in the surface and then shaped by a grinding operation. At least some grooves preferrably spiral about the roller. The pattern of cutting teeth and shape are determined by such variable parameters as pitch, number of thread starts, angle of cutter, depth of cut and lead angle. An incisor for lumber or veneer consists of two rollers at least one of which is as described in the forgoing. The grooves can be filled or partially filled with an elastic compressible material. The incising roller of the foregoing also is used in combination with a veneer lathe.

32 Claims, 6 Drawing Sheets

WOOD TENDERIZING APPARATUS AND METHOD

FIELD OF INVENTION

This invention relates generally to tenderizing wood and more particularly to an incisor roller with cutting formations formed integral therewith for making incisions in wood veneer or lumber. The invention is further directed to an incisor apparatus incorporating one or more of the foregoing rollers.

BACKGROUND OF INVENTION

Wood tenderizing is well known and consists generally of making incisions in wood lumber or veneer for the purpose of improving the drying rate in green lumber, improving the treatability of the wood and in the case of veneer providing uniform strength characteristics which result in reduced buckling and splitting and improved handling on automatic lay-up lines. For various examples of methods and apparatuses for tenderizing veneer, reference may be had to the following: U.S. Pat. Nos.:

U.S. Pat. No. 4,219,060, issued Aug. 26, 1980 to Katsuji Hasegawa;

U.S. Pat. No. 3,678,974, issued July 25, 1972 to J. C. O'Brian;

U.S. Pat. No. 4,486,963, issued Dec. 11, 1984 to Masaru Koike et al;

U.S. Pat. No. 4,473,099, issued Sept. 25, 1984 to Masaru Koike et al;

U.S. Pat. No. 4,469,154, issued Sept. 4, 1984 to Masaru Koike et al;

U.S. Pat. No. 4,442,876, issued Apr. 17, 1984 to Masaru Koike et et al;

U.S. Pat. No. 4,318,433, issued Mar. 9, 1982 to Ralph D. Amundsen; and

U.S. Pat. No. 4,137,956, issued Feb. 6, 1979 to Lloyd Foberg.

While a number of methods and apparatuses are currently used for incising most all, to applicant's knowledge, employ a plurality of incising teeth that are fixed to rollers or platens. As a typical example of separately attached incising teeth attention is directed to the aforementioned U.S. Pat. Nos. 4,318,433 and 4,137,956.

There are a number of drawbacks and limitations to currently available incisors and that is they have a high initial captial cost and also relatively high maintenance costs. The high capital cost comes from manufacturing difficulties of fixing a large number of incising teeth to a backing of some nature with extremely high tolerances. The close or high tolerances are required if there is to be accomplished any semblance of a close and consistent pattern to achieve the desired effect. High maintenance costs are encountered because as the teeth become dull they must be sharpened from time to time or replaced and both represent sizable problems.

Important considerations in the design of an incisor are the geometry of the incising teeth and the frequency and pattern of incisions produced by the incisor.

One object of the present invention is to provide an incising roller that is relatively inexpensive and simple to manufacture and one which can be readily produced and reproduced consistently in a variety of different patterns.

Another object of the present invention is to provide an incising roller that may be formed in a number of different patterns each of which is intended to give particular desired results dependent upon the type and characteristics of the material or veneer to be incised and/or characteristics desired for the incised material.

Another object of the invention is to provide an incising roller wherein the incising teeth are integrally formed with the roll.

Another object of the present invention is to provide an incising apparatus for veneer wherein there is at least one incising roller having a large number of incising teeth formed integrally with the roller.

While incising of veneer can be a single step as in single line operation independent of other processing operations, another object of the present invention is to combine the incising operation with other operations. For example a combined operation can be forming the veneer using a lathe and incising it at the same time and if desired additional means can be provided for controlling the thickness of the veneer. An incising and drying operation is yet another intended combined operation.

SUMMARY OF INVENTION

In accordane with one aspect of the present invention there is provided an incisor roll for use in incising wood comprising an elongate roller and a plurality of knife-like cutting formations projecting from the said roller, said cutting formations being formed integrally with the roller and defined by and separated from one another by grooves in the roller surface. The cutting formations are arranged in selected, predetermined patterns and each has a sharpened straight line cutting edge of finite length extending in predetermined direction relative to the axis of the roller dependent upon the intended usage of the incising roller.

In the preferred form the plurality of cutting formations are separated by grooves formed in the outer surface of the roller and wherein at least some of the grooves are in a spiral path around the surface of the roller. At least some of the spiral grooves preferrably criss-cross one another and may be of equal or unequal number in opposite directions to one another as will be discussed in more detail hereinafter. The cutting formations preferrably result from machining or cutting by a lathe operation, grooves in the outer surface of a roller. For example they are formed by cutting "V"-shaped grooves in a right hand screw-like fashion along the roller and then cutting a left hand screw pattern. By varying the depth of cut, the width of the cut and/or the pitch angle of the screw a variety of tooth geometrics and frequency patterns can be produced. The grooves can if desired by formed by a grinding pattern. As an alternative to machining the grooves can be result from casting or molding and then finished by a grinding or machine cutting operation to provide the requisite knife-like cutting edge.

In accordance with another aspect of the present invention there is provided a incising apparatus comprising two parallel oppositely disposed rollers between which a sheet of veneer can pass and be pressed therebetween and a plurality of cutting formations on the surface of at least one of said rollers for making slits in a selected pattern in said veneer, said cutting formations being spaced apart from one another and located between grooves at least some of which spiral around the surface of the roller to cross other grooves and thereby define and separate the cutting teeth from one another.

LIST OF DRAWINGS

The invention is illustrated by way of example in the accompanying drawings wherein:

FIGS. 8 to 14 are face views of veneer incised using rollers with incising teeth arranged in various patterns and in which FIG. 8 illustrates slit-like cuts in the front face of a portion of a veneer sheet using apparatus with a roller configuration of FIG. 7A;

FIG. 9 is the scoring pattern in the front face of the veneer using the roller configuration of FIG. 7B;

FIG. 10 is the back face of the veneer of FIG. 9;

FIG. 11 is the front face and scoring pattern using the roller configuration of FIG. 7C;

FIG. 12 is the scoring pattern in the front face of a portion of a veneer sheet using the roller configuration of FIG. 7D, and Figs. 13 and 14 are the scoring patterns respectively in the front and rear face of a portion of a veneer sheet using the roller configuration of FIG. 7E;

DESCRIPTION OF PREFERRED EMBODIMENTS

The broadest aspect of applicant's invention is illustrated in FIGS. 1 to 4 and simply consists of a roller of particular construction and design for use in incising wood veneer or lumber. The roller is preferrably a shaft of material (instead of a shaft it can be a thick walled cylinder or a shaft of composite material) with grooves in the outer surface and spiraled thereabout with some grooves crossing others leaving therebetween projections which constitute cutting knives for forming slits in the wood. The cutting knives can be in any one of numerous different shapes and patterns only some of which are illustrated.

In another aspect of applicant's invention there is provided a veneer incising apparatus that employ various different combinations of press and incising rolls some of which are illustrated in FIGS. 7A to 7E and 15.

Figure 17:
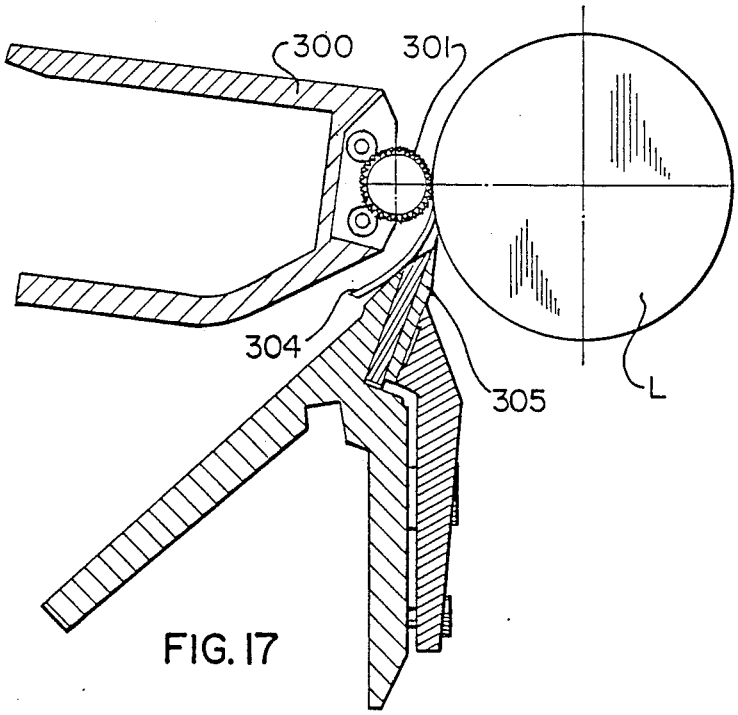
FIG. 17 illustrates a "big bar" lathe.

Another aspect of applicant's invention is illustrated in the form of three different embodiments represented by FIG. 17 and consists of the combined operations of cutting a ribbon of veneer from a log and incising the veneer using incising rollers of the present invention.

Figure 1A:
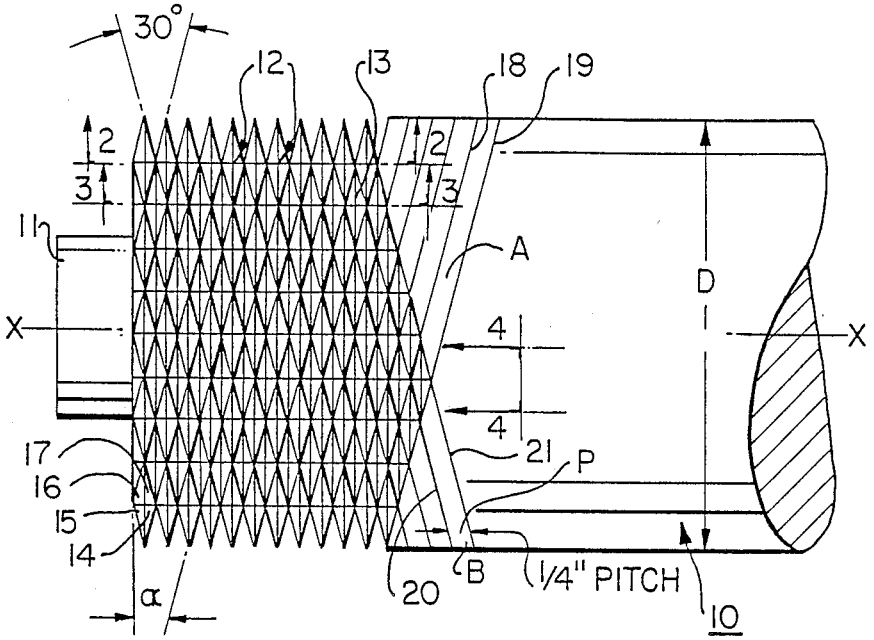
FIGS. 1A and 1B are top plan views of a portion of incisor rollers of the present invention showing two of many different possible patterns.
Figure 1B:
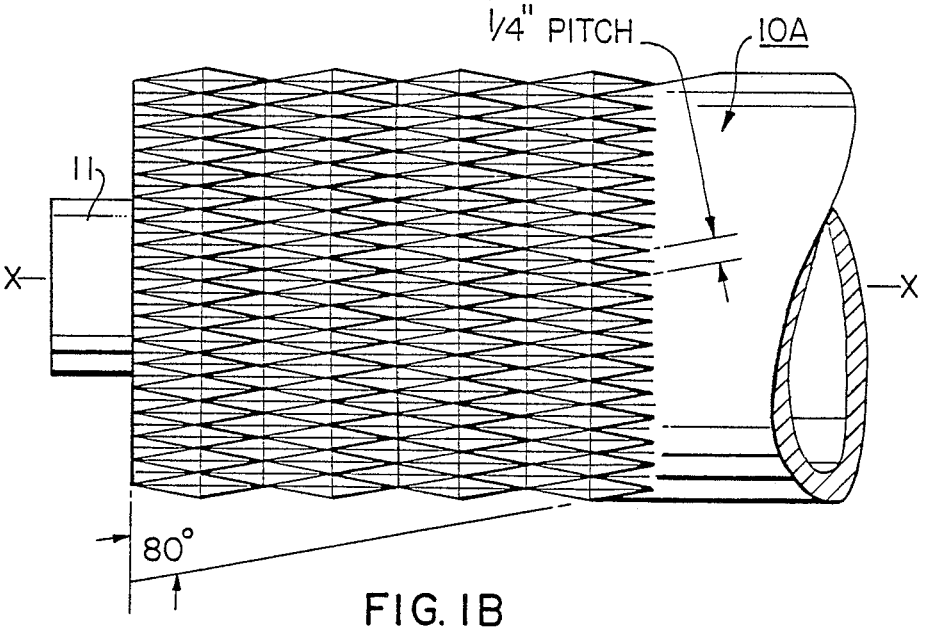
Figure 1C:
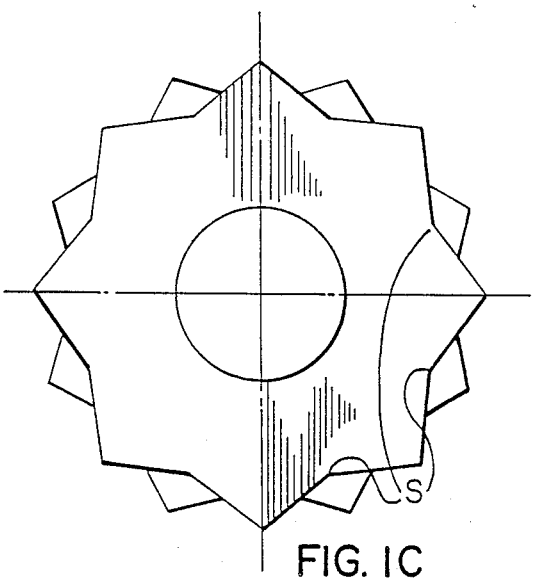
FIGS. 1C and 1D are end elevational views of respective FIGS. 1A and 1B.
Figure 2:
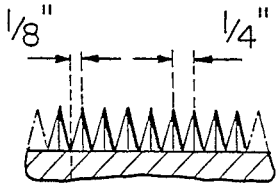
FIG. 2 is a part sectional view along line 2—2 of FIG. 1A.
Figure 3:
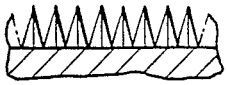
FIG. 3 is a parrt sectional view along line 3—3 of FIG. 1A.

Referring to the drawings, FIGS. 1A and 1B are end portions only of two different incising rollers of the present invention, FIG. 1A representing a shaft roller 10 and FIG. 1B a pipe or thick walled cylinder roller 1OA. Also the incising roller of FIG. 1A is for use in apparatus of a single step operation while roller 1OA of FIG. 1B is for use in apparatus of combined operations. In each instance there is a journal mounting shaft 11 at each of opposite ends of the roller. In each instance the incisor roller is formed by a machine operation using a metal lathe having an appropriate cutting tool or by milling. The cutting tool is usually ground with a sharpness angle of 30° or 60°, but it could be square, rectangular, etc. The operation is similar to screw thread cutting but in the present case the threads run from each end of the roller toward the other end and criss-cross to form the separate teeth. The tooth pattern is determined by various parameters, as will be more fully described hereinafter, such as pitch, number of thread starts, angle of cutter, depth of cut and lead angle. Generally, multiple thread starts are used and these would have a lead angle of about 15° for a veneer incisor roller and about 80° in veneer lathe incising rollers. When there are multiple thread starts they are equally spaced about the circumference, for example a double thread has two starts diametrically opposite i.e. at a point 180° apart. An 8-start thread would have 8 single threads starting at 45° apart. The preferred thread pitch is ¼", but a smaller or larger pitch could be used.

The pattern of the incising teeth is created by the crisscrossing grooves and they are in the form of parallel rows of teeth when similar grooves or thread starts are turned from each end of the roll. There are spiraling rows of teeth about the roller surface when the number of thread starts turned from one end is different from the number cut from the opposite end. The incising teeth of these rollers are perpendicular to the roller axis when the grooves cut have a lead angle of about 15°. Such type of incising roller is illustrated in FIG. 1A which consists of a plurality of incising teeth 12 integrally formed with the shaft roller 10. Each tooth has an elongate knife cutting edge 13 that extends partially about the periphery of the roller in a direction transverse to the shaft axis of rotation designated X—X. Each tooth i2 has four faces designated respectively 14, 15, 16 and 17. Faces 14 and 16, (on opposite sides of the tooth) are as a result of two spaced apart parallel grooves cut spirally in one direction in the face of the roller in the milling or lathe operation. Similarily faces 15 and 17 result from another two separate spaced parallel grooves (i.e. threads) cut in the face of the roller but spiral thereabout in an opposite direction. Referring to FIG. 1A parallel spaced apart grooves 18 and 19 spiral about the roller defining opposites faces 14 and 16 on a plurality of incising teeth in a row A. Grooves 20 and 21 spiral in an opposite direction around the shaft forming tooth faces 15 and 17 respectively.

Grooves 20 and 21 are cut as would a left hand screw thread while grooves 18 and 19 are as a right hand thread. The grooves 20 and 21 are spaced apart and parallel to one another and the plurality of teeth 12 are aligned in a second row designated B that spirals about the roller. Because grooves 18 and 19 intersect grooves 20 and 21 there is provided a plurality of individual incising teeth each with a sharpened cutting edge.

The shape of each tooth is determined by the pitch designated P in FIG. 1A, the number of thread starts (designated S in FIG. 10), the angle of the groove cutter, the depth of cut and the lead angle.

The ranges and considered best within the range of these parameters are as follows:

| INCISOR PARAMETERS | Ranges | Probable Best |
|---|---|---|
| Pitch | $\frac{1}{8}''$ to $\frac{1}{2}''$ | ($\frac{1}{4}''$ and $\frac{3}{8}''$) |
| No. of thread starts (from from each end of roll) | 1 to 10 | (1,2,8,9) |
| Angle of cutter | 20° to 60° | (30° or 60°) |
| Depth of Cut (normally but not necessarily greater than veneer thickness) | up to $\frac{1}{2}''$ | ($\frac{3}{8}''$ to $\frac{1}{2}''$) |
| Lead angle | 0° to 90° | (° to 15° incisor i.e. single operation) (75° to 90°) lathe and incisor i.e. combined operation |

The parameters of the incising rolls illustrated respectively in FIGS. 1A and 1B are as follows:

| | FIG. IA | FIG. 1B |
|---|---|---|
| Pitch P = | $\frac{1}{4}''$ | $\frac{1}{4}''$ |
| Lead Angle = | 15° | 80° |
| Roll diameter D = | $5\frac{1}{4}''$ | $5\frac{1}{4}''$ |
| Number of Thread Starts S = | 8 (FIG. 1C) | 8 |

The roll diameter can be of most any size. The foregoing size of $5\frac{1}{4}''$ was found through experiments operative but such size is not to be construed as limiting. It will be observed the cutting edges of the teeth in FIG. 1A are transverse to the roll axis while in FIG. 1B they are parallel to the roll axis. In the latter embodiment the grooves are formed by milling rather than turning and such embodiment is for use in a combined operation of incising and lathe forming the veneer.

Figure 5:
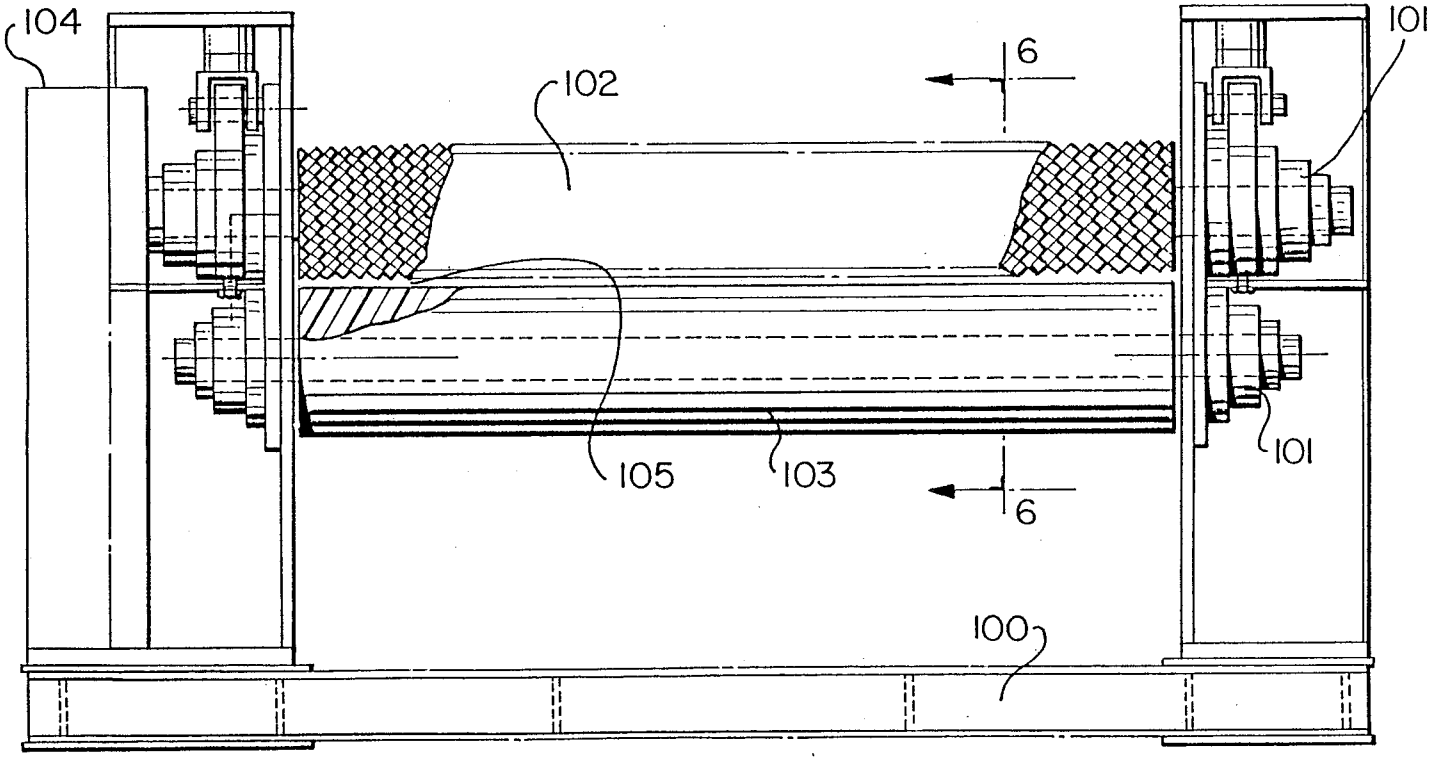
FIG. 5 is a partial front elevational view of a veneer incising machine.
Figure 6:
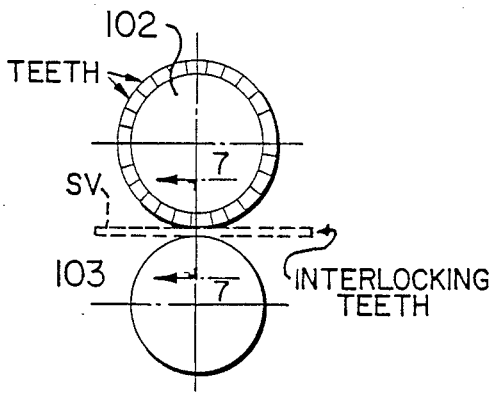
FIG. 6 is a sectional view along line 6—6 of FIG. 5.

A veneer incising machine is partially shown in FIGS. 5 and 6 and includes a frame 100 having a pair of parallel spaced apart rollers journalled therein by bearings 101. The upper roll 102 and/or the lower roller roll 103 are driven by a suitable power source and/or drive train generally designated by reference 104. The upper and/or lower respective rolls 102 and 103 can be incising rolls and in the case illustrated in FIG. 5 the upper roll 102 is an incising roll and the lower roll 103 is a rubber faced back up roll. The rolls are closely adjacent one another providing a nip 105 therebetween for receiving a sheet of veneer SV (see FIG. 6).

Different roll patterns and different combinations of rolls can be used to provide different characteristics of the incised wood depending upon its use and intended purpose for the incising. FIGS. 7A to 7E are cross-sections effectively along line 7—7 of FIG. 6 illustrating a few different roll pattern combinations and some veneer incising patterns resulting therefrom are shown in FIGS. 8–14.

Figure 7A:
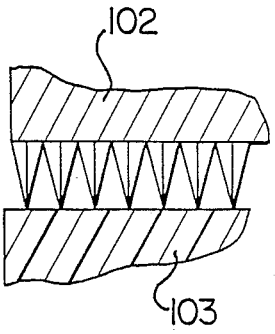
FIGS. 7A and 7E are enlarged partial sectional views essentially along line 7—7 of FIG. 6 illustrating veneer incisors with incising rollers of the present invention with different patterns and in different combinations.
Figure 8:
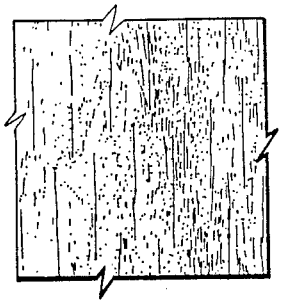

FIG. 8 is the incising pattern (referred to herein as pattern 1) on the front face of a veneer sheet that results from the roll combination of FIG. 7A.

This pattern exemplifies an incisor pattern on roller 102 produced under condition (a) by 9 multiple thread starts from each end and a pitch of 5/16", thus forming a 6° incising tooth with 15° lead angle and tooth depth of 5/16".

A similar pattern is produced under condition (b) where the tooth parameters are as follows: pitch $\frac{1}{4}''$, a 30° incising tooth, 8 multiple thread starts and a depth of 178 '. This results in longer and sharper teeth than in the foregoing and more frequent incisions across the veneer. In each instance back-up roll 103 is a rubber faced roller.

Tests performed for conditions (a) and (b) provided the following:

The reduction in drying rate was larger for (a) than for (b) with (a) giving as much as a 15% reduction for drying time while (b) gave a reduction of 10%. The benefit with respect to treatability was higher for (b) than for (a) with (a) showing a 50% improvement in penetration in spruce veneer over non-incised veneer while (b) gave a 75% improvement in penetration over a control. With respect to blows delamination was reduced by 50% when 10% M/C (moisture content) incised veneer was used over similar M/C non-incised veneer.

Figure 9:
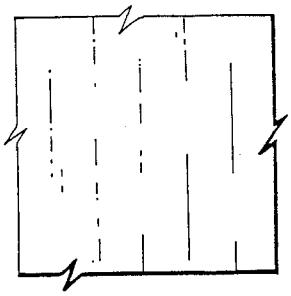
Figure 10:
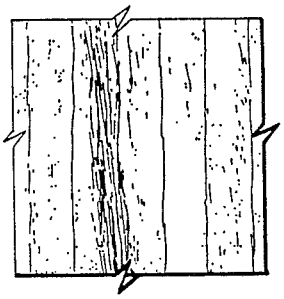
Figure 15:
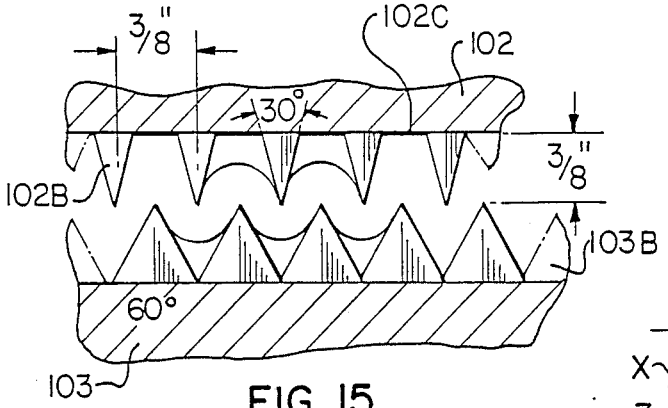
FIG. 15 is a view similar to FIG. 7B but with some modifications.

FIGS. 9 and 10 are the patterns respectively on the front and rear face of the veneer from the roll combination of FIG. 15 This is sometimes referred to herein as pattern 2 which also can be referred to as the reverse bend pattern. In this embodiment of the apparatus the upper and lower respective rolls 102 and 108 have incising teeth resulting from the following parameters lead angle of 0°, pitch $\frac{3}{8}''$, depth $\frac{3}{8}''$, 60° tooth on bottom roll, 30° tooth on top roll. This pattern gave exceptional reduction in blows during plywood pressing. When 10% moisture content veneer was used all control panels blew while none of the panels produced from incised veneer blew or delaminated (a blow results when gas is entrapped between veneer layers and is under sufficient pressure as to overcome the glue bond and thus results in a separation of the layers. With respect to treatability Pattern 2 was slightly less than Pattern 1. The bottom roll 103 of FIG. 15 (which also has the same knife pattern as roll 103 of FIG. 7B) has effectively a plurarlity of side by side spaced apart grooves perpendicular to the roller axis that define the cutting knives i.e. the grooves do not spiral about the roller. The ribs between the grooves are continuous about the roller. In FIG. 15 the top roll 102 has the ribs cross-cut by grooves that preferrably spiral about the roller whereby each rib provides a plurality of cutting teeth spaced about the periphery of the roller.

Figure 7B:
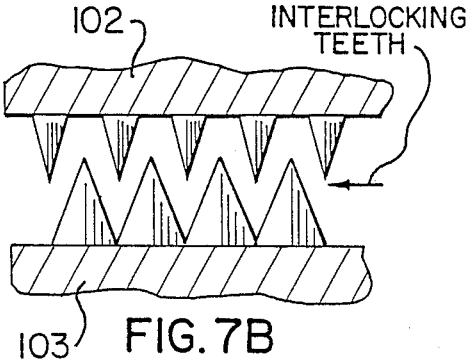
Figure 7C:
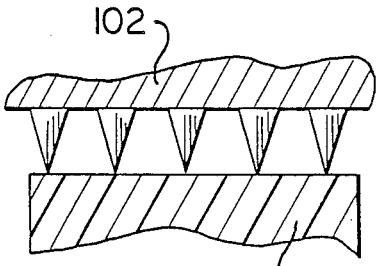
Figure 11:
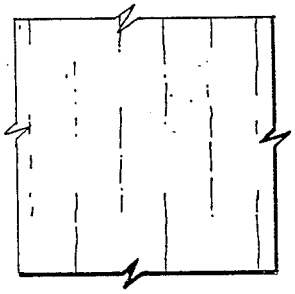

Pattern 3 is shown in FIG. 11 and results from the combination of an upper roller 102 as in FIG. 7C and described above with a lower roll or anvil 103 that is coated with a resilient material (rubber) and with a smooth surface. In terms of drying, treatability and blows Pattern 3 was less effective than Pattern 1 or Pattern 2.

Figure 7D:
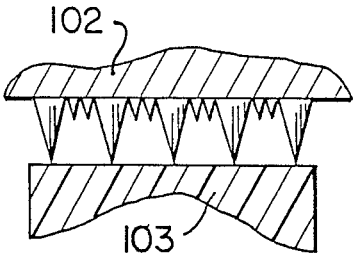
Figure 12:
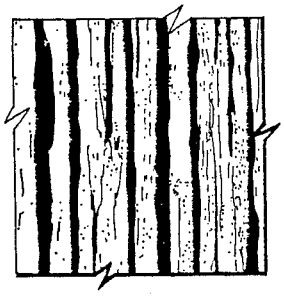

FIG. 12 illustrates Pattern 4 resulting from the apparatus of FIG. 7D. The incisors were made using a machined upper roller 102 and an anvil lower roll 103 having a smooth resilient surface. The incising roller 102 was made by cutting 3 threads per inch in one direction and 4 threads per inch in the opposite direction. This produced a 60° tooth.

A 30° incising tooth rendere essentially the same pattern. Benefits in drying were for the 60° tooth 12% and for the 30° tooth 8% reduction in drying time. Performance with respect to treatability and blows was better than Pattern 1.

Figure 7E:
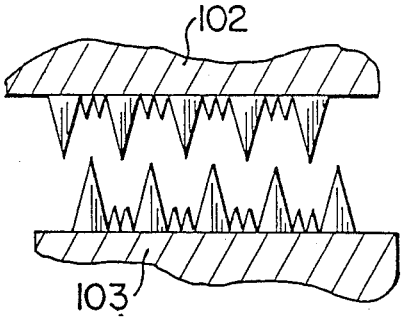
Figure 13:
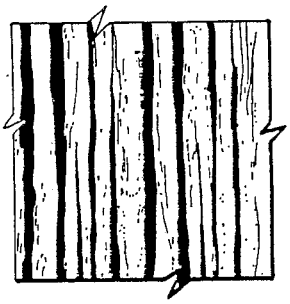
Figure 14:
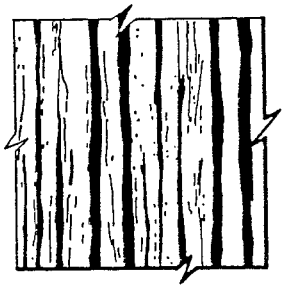

Pattern 5 is shown in FIGS. 13 and 14 which are respectively the front and rear face of a veneer sheet incised with the roll combination of FIG. 7E. Each roller 102 and 103 has incising teeth made as in the previous case by cutting 3 threads per inch in one direction and 4 threads per inch in the opposite direction. As with Pattern 4 the benefits for drying, treating and blow reduction were all high but the power requirement for Pattern 5 was substantially less than for Pattern 4.

Figure 16:
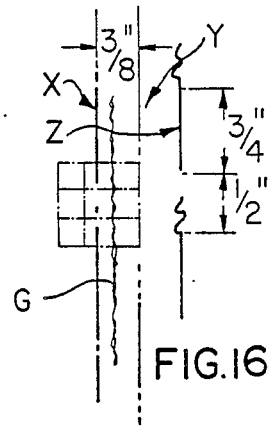
FIG. 16 is an incising pattern in veneer using the arrangement of FIG. 15.

In all of the embodiments described in the foregoing, with the exception of FIG. B7, the teeth are formed by grooves that criss-cross, i.e. the groove lead angle is greater than 0°. In FIG. 7B the groove lead angle is 0°, i.e. the grooves are parallel to one another and perpendicular to the roll axis. A further illustration of this is shown in FIG. 15 and the resultant incising pattern from the use thereof is shown in FIG. 16. Referring to FIG. 15 the top roll 102 has parallel ribs 102B extending thereabout each having an apex with an included angle of 30° and spaced apart at $\frac{3}{8}''$ intervals. The ribs 102B are separated one from the other by a flat portion 102C, i.e. adjacent ribs are separated by a flat bottomed groove. Each rib is interupted about the periphery of the roller by cross-cut grooves that preferrably spiral about the roller i.e. each rib 1s interupted thereby each rib provides a plurality of cutting knives.

The bottom roll 103 in FIG. 15 has side-by-side abutting ribs 103B each having an apex included angle of 60°. Ribs 103B are transverse to the roll axis and have depth of $\frac{3}{8}''$ as do ribs 102B. Again the lead angle is 0°.

The ribs 102B are intersected as mentioned by grooves that can be parallel to the roll axis or spiral thereabout providing a plurality of teeth on each rib that are circumferentially spaced about the roll. This spacing results in a pattern of slits in the veneer shown in FIG. 16 arranged in rows and spaced from one another lengthwise and sideways of the sheet. Referring to FIG. 16 these rows, designated X, Y and Z, are shown each having slits W of about $\frac{3}{4}''$ in length and spaced from the next in the same row by about $\frac{1}{2}''$. The rows are spaced $\frac{3}{8}''$ apart. The ribs 103B offset longitudinally along the roll from ribs 102B cause reverse bending and in addition to the slits cut in the veneer there is a crack from the bending which is shown as a wavy line designated G between rows X-Y and between the rows Y-Z.

Applicants incising roll, as described in the foregoing, can be used in an incising apparatus where the individual sheets of veneer or pieces of wood are incised or alternatively they can be used in a combination process. FIG. 17 shows diagramatically and by way of example a veneer lathe with one incising roll of the foregoing type mounted on the nose bar thereof. The lathe of FIG. 17 is what is known in the trade as a "big bar" type lathe having a nose bar 300. An incising roll 301 of the present invention is journalled for rotation on the big bar 300 for rotation about an axis parallel to the axis of rotation of the bolt L. The big bar lathe is a spindle type lathe and as the log or bolt L is rotated a ribbon of veneer 304 is cut from the bolt by a knife 305 downstream from the point of contact of the incising roll 301 with the bolt.

In the foregoing there is described an incising roll of suitable material (normally metal) having teeth formed integrally with the roll by cutting grooves in the roll surface. The roll can be a solid shaft or formed from a center core of any material and covered with a metal sleeve or be a thick walled cylinder. In either embodiment and as a further embodiment the incising roll can have the grooves at least partially filled with a resilient compressible material such as rubber, neosprene, or the like. If desired the knife-like cutting edges on the roller can be embedded in, i.e. below the outer surface of the resilient coating when the latter is in its normal at rest uncompressed state. When incising this resilient coating is in rolling pressural engagement with the surface of the piece being incised.

Figure 1D:
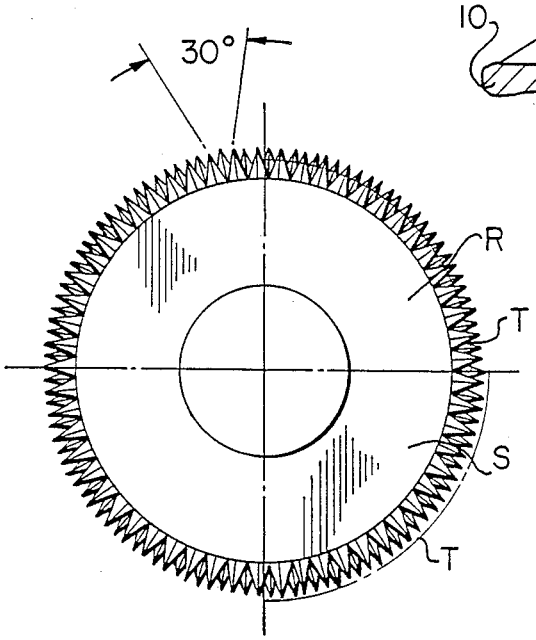

By way of example, FIG. 1D in roller quadrant R, there is illustrated a compressible elastic coating T that only partially fills the grooves that define the teeth and thus the knife-like cutting edges project therebeyond. In quadrant S of the same figure the cutting edges of the incising teeth are shown embedded in the compressible elastic coating T. A coating T is also shown in FIG. 15 which may be on one or both or neither of the rolls.

In the foregoing, the grooves are described as being formed in the roller by a machining operation. There are, of course, other alternative ways obvious to those skilled in the art of making the incising rolls with the grooves. For example, the grooves can be formed during molding or casting of the roller or by a roll-forming operation and then machined or ground to the desired sharpness for the cutting edges. Also, it will be obvious to those skilled in the art, the roller can be made with strong but perhaps a relatively soft material, for example aluminum, which is easy to machine or form or shape and then coat the surface with a hard material. There is no real load on the teeth other than a compressive load during operation.

Figure 4:
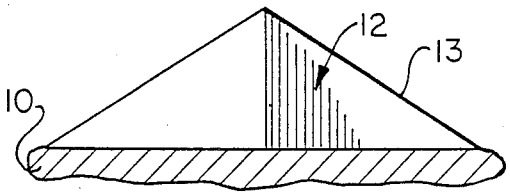
FIG. 4 is a view essentially along line 4—4 of FIG. 1A showing a single tooth in enlarged side view.
Figure 4B:
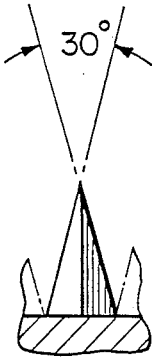
FIG. 4B is a side elevational view of FIG. 4.
Figure 4A:
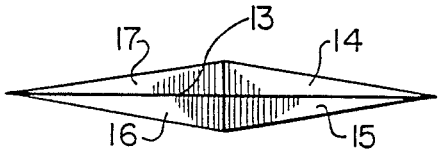
FIG. 4A is a top view of FIG. 4.

It should also be pointed out applicant'tooth shape is extremely important as there results no bending during use as is the case in the prior art. Each tooth is effectively a double wedge shape best illustrated perhaps by reference to FIGS. 4 and 4A. With reference to FIG. 4, if one is to assume the cutting tooth 12 fully impales the veneer which is a thickness approximately equal to the maximum depth of the tooth, there is a gradual penetration, during rotation of the roller, of the cutting edge 18. During this gradual penetration of the tooth there is also a gradual widening, i.e. the second wedge as illustrated in FIG. 4A, of the faces 16 and 17 (or if the direction is reversed, faces 14 and 15). This double wedging action has a tendency to avoid deflection when encountering more dense pieces of wood, for example where there are knots. Since there is no bending on the teeth strength is not a major criteria for forming the teeth, but instead having a material which will maintain a relatively sharp knife-like cutting edge during use.

The embodiments of the invention in which an exclusive property or privilege is claimed are defined as follows:

1. A wood incising roll comprising:

an elongate structurally rigid roller having a plurality of formations projecting therefrom and which are an integral part of the outer periphery of the roller, said cutting formations being spaced apart from one another in a selected predetermined pattern and each having a knife-like cutting edge of finite length extending in a predetermined direction relative to the axis of rotation of the roller, said plurality of formations being defined by grooves in the surface of the roller crossing one another.

2. An incising roll as defined in claim 1 wherein at least some of said grooves spiral around the outer periphery of the roller.

3. An incising roll as defined in claim 1 wherein a first and second set of grooves spiral respectively in opposite directions around the periphery of the roller.

4. An incising roll as defined in claim 1 wherein said projecting formations each taper symmetrically with respect to a plane perpendicular to the axis of rotation of the roll.

5. An incising roll as defined in claim 1 wherein the knife-like cutting edge on each of said formations gradually increases in radial extent from the roller axis in a direction opposite the direction of rotation of the roller.

6. A wood incising roll comprising an elongate structurally rigid roller, and grooves in the surface of said roller that spiral in opposite directions around the periphery of the roller defining therebetween a plurality of formations projecting form said roller and which are integral therewith, said cutting formations being spaced apart from one another in a selected predetermined pattern and each having a straight line knife-like cutting edge of finite length extending in a predetermined direction relative to the axis of rotation of the roller.

7. An incising roll as defined in claim 6 wherein there are an equal number of grooves in each of the opposite spiral directions.

8. An incising roll as defined in claim 6 wherein there are more spiral grooves in one direction than in the other.

9. A wood incising roll comprising an elongate structurally rigid roll and grooves in the surface of said roller defining therebetween a plurality of formations projecting from said roller and which are integral therewith, said cutting formations being spaced apart from one another in a selected predetermined pattern and each having a straight line knife-like cutting edge of finite length extending in a predetermined direction relative to the axis of rotation of the roller, wherein said plurality of cutting formations are disposed between grooves in the surface of the roller at least some of which spiral around the outer periphery of the roller and wherein there are at least two spiral grooves that start in a common plane transverse to the roller axis of rotation with such starts being equally spaced circumferentially about said axis.

10. An incising roll as defined in claim 6 wherein the lead angle of all the starts is the same and within the range of 10° to 80°.

11. An incising roll as defined in claim 10 wherein the pitch for the spiral grooves is within the range of $\frac{1}{8}''$ to $\frac{3}{4}''$.

12. An incising roll as defined in claim 6 wherein the parameters are within the range as follows:

| | |
|---|---|
| Pitch | $\frac{1}{8}''$ to $1\frac{1}{2}''$ |
| Lead Angle | 0° to 90° |
| Depth | up to $\frac{1}{2}''$ |
| No. of Thread Starts | 1 to 10 |
| Angle of Cutter | 20° to 60° |

13. An incising roll as defined in claim 12 wherein the parameters are as follows:

| | |
|---|---|
| Pitch | $\frac{1}{4}''$ $\frac{3}{8}''$ |
| Lead Angle | 30° to 60° |
| Depth of Cut | $\frac{3}{8}''$ to $\frac{1}{2}''$ |
| Lead Angle | 0° to 15° for incisor and 75° to 90° for combined lathe incisor. |

14. A wood incising roll comprising an elongate structurally rigid roller, and grooves in the surface of said roller defining therebetween a plurality of formations projecting from said roller and which are integral therewith, said cutting formations being spaced apart from one another in a selected predetermined pattern and each having a straight line knife-like cutting edge of finite length extending in a predetermined direction relative to the axis of rotation of the roller wherein a first set of grooves are in parallel spaced relation to one another transverse to the axis of rotation of the roller and a second set of grooves transverse said first set of grooves.

15. An incising roller as defined in claim 14 wherein said second set of grooves spiral about the outer periphery of the roller.

16. An incising roller as defined in claim 14 wherein said second set of grooves are parallel to said roller axis of rotation.

17. In a veneer incising apparatus of the type having at least one pair of parallel rollers between which sheets of veneer are passed flatwise and pressed between such pair of rollers and wherein at least one of such rollers has incising teeth projecting from the periphery thereof to cut slits in the veneer the improvement comprising an elongate incising roll having teeth formed integrally therewith and arranged in a predetermined pattern around and along an axial length of the roll, said plurality of teeth being defined as projections between a plurality of grooves in the outer surface of the roller with at least some of the grooves crossing others to define the teeth.

18. The improvement as defined in claim 17 wherein each of said teeth have a knife-like cutting edge of finite length.

19. The improvement as defined in claim 17 wherein each of said rollers has projections on the outer periphery.

20. The improvement as defined in claim 19 wherein one of said rollers has a plurality of parallel spaced apart grooves transverse to the rollers axis of rotation and wherein the other roller is an incising roller.

21. The improvement as defined in claim 17 wherein each of said rollers is an incising roller.

22. In a veneer incising apparatus of the type having at least one pair of parallel rollers between which sheets of veneer are passed flatwise and pressed between such pair of rollers and wherein at least one of such rollers has incising teeth projecting from the periphery thereof to cut slits in the veneer the improvement comprising an incising roll having teeth formed integrally therewith and arranged in a pattern defined as projections between a plurality of grooves in the outer surface of the roller with at least some of the grooves crossing others to define the teeth wherein each of said rollers is an incising roller, and wherein each said incising roller has grooves running in a spiral fashion about the roller and in each of opposite directions.

23. The improvement as defined in claim 22 wherein there are an equal number of V-shaped grooves in each of the opposite spiral directions.

24. An incising roll comprising an elongate rigid roller with grooves in the surface thereof that intersect one another providing therebetween a plurality of projections each of which has a knife-like cutting edge.

25. An incising roll comprising an elongate rigid roller with grooves in the surface thereof that intersect one another providing therebetween a plurality of projections each of which has a knife-like cutting edge and a resilient compressible coating on the periphery of said roller at least partially filling said grooves.

26. An incising roller as defined in claim 25 wherein said knife-like cutting edges are below the outer surface of coating when the latter is in an uncompressed, at rest state.

27. An incising roll as defined in claim 24 wherein each of said projections tapers symmetrically with respect to a plane perpendicular to the axis of rotation of the roll.

28. An incising roll as defined in claim 27 wherein said knife-like cutting edge lies in said plane and has an initial leading edge portion that gradually increases in radial extent from the roller axis in a direction opposite the direction of rotation of the roller.

29. A wood incising roll comprising an elongate structurally rigid roller having a plurality of spaced apart formations projecting outwardly from the peripheral surface thereof, said formations being disposed in a selected predetermined pattern defined by a preselected arrangement of grooves crossing one another, each said projecting formation having a knife-like cutting edge of finite length extending in a predetermined direction relative to the axis of rotation of the roller.

30. An incising roll as defined in claim 29 wherein said grooves are cut and arranged in spirals around the periphery of the roller with one group in one direction and another group spiralling in the opposite direction.

31. An incising roll as defined in claim 29 wherein there are an equal number of grooves in each of the opposite spiral directions.

32. An incising roll as defined in claim 29 wherein there are more spiral grooves in one direction than in the other.

* * * * *